US006137582A

United States Patent [19]

Stedham

[11] Patent Number: 6,137,582

[45] Date of Patent: Oct. 24, 2000

[54] DEVICE FOR DETERMINING MEASURED VALUES, ESPECIALLY THE CONCENTRATION OF AN AEROSOL IN A CLOSED SPACE OF A WORKING MACHINE

[75] Inventor: David Stedham, Reno, Nev.

[73] Assignee: Electrical Engineering Company Ltd., Liechtenstein, Switzerland

[21] Appl. No.: 09/254,799

[22] PCT Filed: Sep. 12, 1997

[86] PCT No.: PCT/CH97/00338

§ 371 Date: Jun. 1, 1999

§ 102(e) Date: Jun. 1, 1999

[87] PCT Pub. No.: WO98/11331

PCT Pub. Date: Mar. 19, 1998

[30] Foreign Application Priority Data

Sep. 13, 1996 [CH] Switzerland ..... 2244/96

[51] Int. Cl.[7] ..... G01N 21/00

[52] U.S. Cl. ..... 356/436

[58] Field of Search ..... 356/432, 434, 356/436, 437, 440, 438, 439; 250/227.23; 73/73–79; 385/12; 439/130

[56] References Cited

U.S. PATENT DOCUMENTS

| | | | |
|---|---|---|---|
| 4,917,491 | 4/1990 | Ring et al. | 356/436 |
| 5,510,895 | 4/1996 | Sahagen | 356/436 |

FOREIGN PATENT DOCUMENTS

| | | | |
|---|---|---|---|
| 0 071 391 | 10/1986 | European Pat. Off. | F01M 11/10 |
| 804541 | 11/1958 | United Kingdom | 356/436 |

*Primary Examiner*—Hoa Q. Pham
*Attorney, Agent, or Firm*—Randall J. Knuth

[57] ABSTRACT

The invention concerns a device containing a measuring probe (M) which is placed at a wall (1) of a motor and projects into the chamber of a working machine. The measuring probe (M) has a conductor (L) that sticks out of the chamber and is coupled to a bus coupler (K) connecting it to a bus bar (S).

18 Claims, 8 Drawing Sheets

DEVICE FOR DETERMINING MEASURED VALUES, ESPECIALLY THE CONCENTRATION OF AN AEROSOL IN A CLOSED SPACE OF A WORKING MACHINE

BACKGROUND OF THE INVENTION

1. Field of the Invention

The present invention relates to device for measuring aerosol concentrations in a chamber or machine.

2. Description of the Related Art

Monitoring of aerosol concentrations, especially lubricant mist in the drive spaces of internal combustion engines or in the housings of power trains, for example, in printing presses, is of major importance in avoiding damage, since a rapid rise in the oil mist concentration suggests rupture of the lubricating film. Because of the heat of friction that then develops, oil vapor is formed, which recondenses to oil mist in the drive space and thus leads to a rapid rise in oil mist concentration. An incipient hazard can be recognized from this and further damage avoided by appropriate measures, for example, stopping of the machine.

In addition to the already described oil mist formation, so-called blow-by can occur in piston engines between the piston and cylinder wall as a result of damaged piston rings, owing to lubricating film tears in the bearings, which, if not recognized in time, lead to seizing of the pistons. An increase in oil mist density with a simultaneous temperature rise as a result of the hot combustion gases reaching the crankshaft housing suggest blow-by.

Devices to indicate oil mist concentrations in the drive spaces of internal combustion engines are known (EP-B-0 071 391), in which the oil mist is withdrawn by suction from the drive space and passed through a chamber that contains a device to measure absorbance. The significant design and operating expense (e.g., pumps, maintenance), the possible de-mixing of the aerosol "oil mist" on the way to and through the chamber, and the time delay during measurement are drawbacks.

A device of the type mentioned at the outset is known from DD-A-239 474 or GB-A-2 166 232, in which a measurement probe is provided for each drive of an internal combustion engine, in which each measurement probe is directly arranged in the interior of the corresponding drive space and connected via an optical or electrical transmission path to a central evaluation unit situated outside of the internal combustion engine.

SUMMARY OF THE INVENTION

The present invention relates to a device for determining measured values in a chamber of a machine. The device comprises a housing of the machine, an evaluation device arranged outside of the housing, a measurement probe attached to the housing and extending into the chamber, an oscillating system having a line connected between the measurement probe and the evaluation device, and a support rail containing a bus rail with a bus line rail, the line connected to a bus coupler containing a converter arranged in the bus rail, the bus line rail arranged elastically within the support rail so that the system is tuned to a low frequency.

One advantage of the present invention is to incorporate the oil mist sensor device in a rapid assembly system.

Another advantage of the invention is to design the entire system water-tight enough that spray water cannot penetrate into the electrical circuitry during cleaning of the engines.

Yet another advantage of the invention is to protect the electronic converter system from damage by vibrations that are generated by the running engine, as well as electromagnetic influences from the outside and, on the other hand, to prevent electromagnetic radiation from being emitted outward from the electronic circuits.

The measurement probe can be designed to determine different measured values, like the temperature or other physical quantities. However, it is preferably designed to determine the concentration of an aerosol, especially an oil mist.

The measurement probe can be directly connected to an evaluation unit or to a bus rail via a bus coupler. The bus rail can be connected to a converter and an evaluation unit for the measured signals. The bus coupler is preferably designed directly as a converter and the bus rail connected to an evaluation unit.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

List of Reference Numbers

K Bus coupler

L Line

M Measurement probe

S Bus rail

1 Engine wall

2 Guide tube for measurement chamber

3 Venturi channel nozzle

4 Drive space atmosphere

5 Removal site for partial vacuum

6 Outflow channel

7 Measurement chamber

Figure 1:
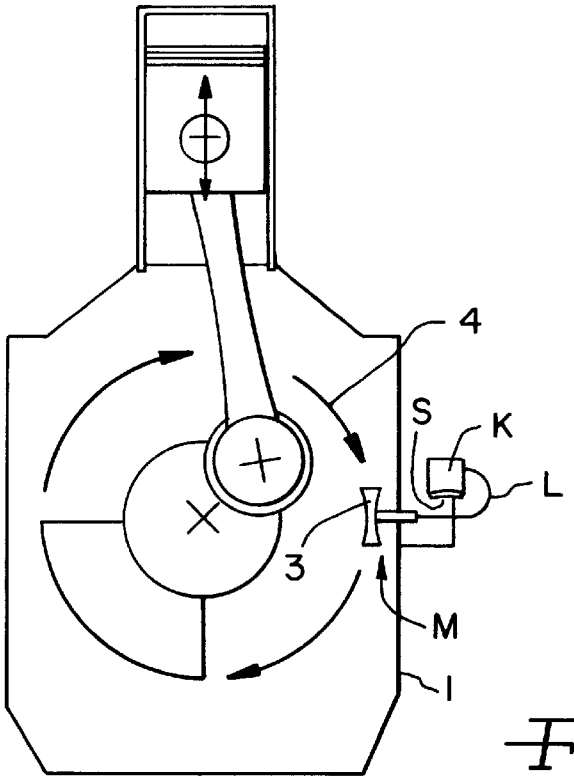
FIG. 1 is a shows a monitoring device on a machine in vertical section.

8 Feed site for drive space atmosphere

9 Labyrinth

10 Measurement zone

11 Fiber optic cable

12 Glass fibers for light feedline

13 Glass fibers for light return line

14 Fiber optic bundle mount

15 Convergent lens

16 Triple reflector

17 Electronic converter system

18 Bus line rail

19 End bus line rail

20 Bus support rails

21 Support rail intermediate pieces

22 Bus support rail mount

23 Tension nut

24 T-shaped insertion tongue

25 T-shaped mount with the bus support rail

26 Synthetic resin block

27 Flexible conducting film

28 Contact terminals flexible film

29 Contact spring assembly

30 Rubber skin bus coupler

31 Bus coupler

32 Slit-like opening bus coupler

33 Hollow snap-in groove

34 Winding channel

35 Support lips

36 Tubular opening

37 Light-emitting diode

38 Light-sensor diode

39 Bus countercontacts

40 Bus board with etched bus lines

41 Bus metal rails

42 Spring support hook profile

43 Bus rubber skin

44 Slit-like bus countercontact opening (bus coupling site)

45 Sealing rim

46 Rubber support profile bus

47 Support groove bus support rail

48 Elastic rubber connection

49 Slotted tube

50 Slit with slotted tube

51 Support tongue

52 Groove profile on slotted tube

53 Collecting channel

54 Support profile collecting channel

55 Support groove in the bus support rail

56 Slotted passage in collecting channel

57 Inlet site fiber optic cable on bus coupler

58 Inlet site fiber optic cable into the winding channel

59 Loops remaining length fiber optic cable of the bus coupler

60 Support groove on bus coupler

61 Sensor unit

62 Locking groove on bus coupler

63 Locking hooks

64 Support rail closure cover

65 Cover hinge

66 Holding tab

67 Introduction slit for fiber optic cable

68 Bus connection line

69 Bus line rail coupler

70 Connection tongue

71 Connection element made of conducting rubber

72 Metal clamping tongues

73 Metal frame

74 Metal frame clamping tongues

75 Frame groove

76 Signal evaluation unit

77 Connection line

78 Plug-in connection

79 Metal terminal plate

80 Loops

FIG. 1 shows a device for determining measured values, preferably of an aerosol, especially oil mist, in an engine compartment, preferably of a diesel engine, arranged on a machine, for example, a piston engine. The device contains a measurement probe (M) that extends through the engine wall (1), which is connected via a conductor (L) to a bus coupler (K) arranged on the outside of the engine on a bus rail (S).

Figure 2:
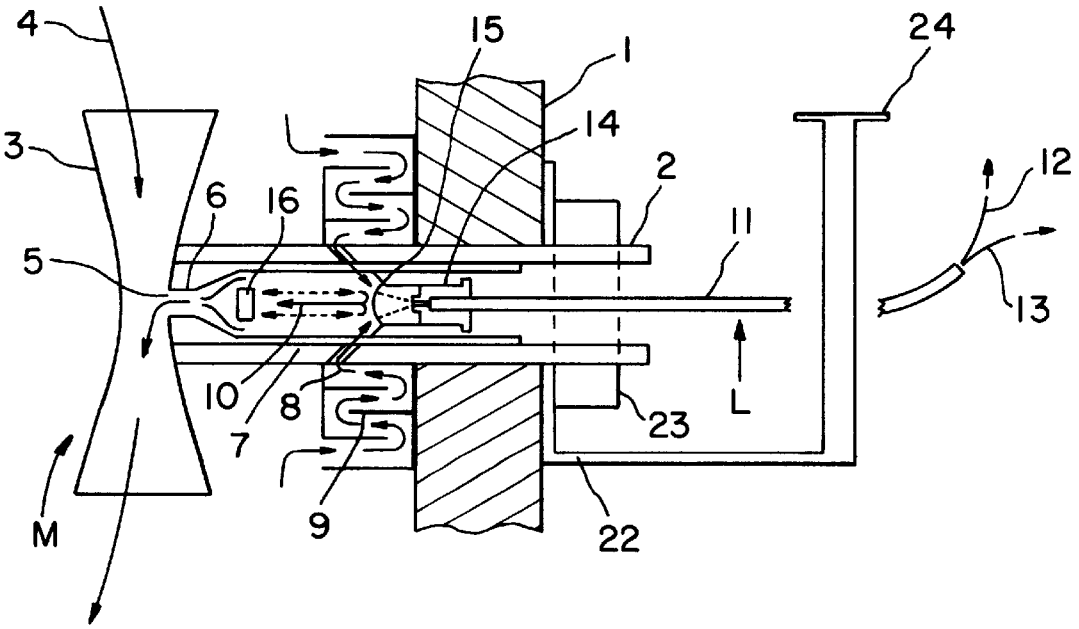
FIG. 2 shows a measurement probe of the monitoring device of FIG. 1 in vertical section on a larger scale.

For this purpose, as shown in FIG. 2, a guide tube (2) of measurement probe (M) is screwed into engine wall (1), on which a Venturi channel nozzle (3) is fastened. The drive space atmosphere (4) placed in circular motion by crankshaft rotation flows through the Venturi channel nozzle (3) and creates a partial vacuum at the withdrawal site (5). The measurement chamber (7) is connected to this partial vacuum via outflow channel (6). The drive space atmosphere enters the measurement chamber (7) at the feed site (8) and flows through it and emerges again at the withdrawal site for the partial vacuum (5) and goes back to the drive space atmosphere (4) via the Venturi channel nozzle (3).

A labyrinth (9), which prevents the oil spray from penetrating measurement chamber (7), is connected to the feed site (8) for the oil mist in the drive space atmosphere. The measured signals for oil mist density are recovered in a measurement zone (10) in measurement chamber (7). For this purpose, the measurement chamber (7) is connected on one end to a glass fiber cable (11) with glass fiber bundles running in it for light feedline (12) and light return line (13).

The two glass fiber bundles (12) and (13) end in a glass fiber bundle bracket (14) with a ground glass fiber outlet surface. A convergent lens (15) is situated in front of this bracket, which directs the light fed via the glass fiber bundle (12) through the measurement zone (10) to the triple reflector (16). The triple reflector (16) reflects the light independently of precise adjustment of convergent lens (15) and triple reflector (16) precisely back to lens (15), which, in turn, again focuses the light in glass fiber bundle (13) so that it can be withdrawn at the end of the fiber optic cable (11) for electronic conversion.

If the drive space atmosphere drawn into measurement chamber (7) via labyrinth (9) and feed site (8) through the partial vacuum created in Venturi nozzle (3) contains oil mist, the light passing through measurement zone (10) in both directions, namely from lens (15) to triple reflector (16) and back again to lens (15), is attenuated in intensity, so that the light fed back through fiber optic bundle (13) triggers a smaller electronic signal amplitude during electronic signal conversion at the end of the fiber optic cable (11).

The solution to the task of incorporating the oil mist sensor device in a rapid assembly system is seen in the fact that only a few different standard installation components are used and the system flexibility required for adaptation to different engine types is restricted to only a few modifiable system components.

For this purpose, the attenuation signals recorded by the sensors with the measurement zone (10) from the different compartments, depending on the oil mist density, are fed via line (L) to bus coupler (K), which is designed as a converter, of bus rail (S), as can be gleaned in particular from FIGS. 3 to 14. Each bus coupler (K) contains an electronic converter system (17) that converts the measured signals and feeds them to a bus line rail (18), to whose end (19) an electronic evaluation unit is connected (not further shown). The bus line rails (18) are inserted in metallic bus support rails (20) that have a fixed standard length. These bus support rails (20), depending on the engine type and requirements, are distributed over the entire length of the engine and the intermediate spaces then formed by support rail intermediate pieces (21) are closed by mechanical coupling to the bus support rails (20).

The bus rails (S) with the bus support rails (20) are again attached to the engine wall through bus support rail brackets (22). The bus support rail brackets (22), in turn, are attached to the guide tube of the measurement chamber (2) by means of a tension nut (23), as follows in particular from FIGS. 1 to 5 and 7.

Figure 8:
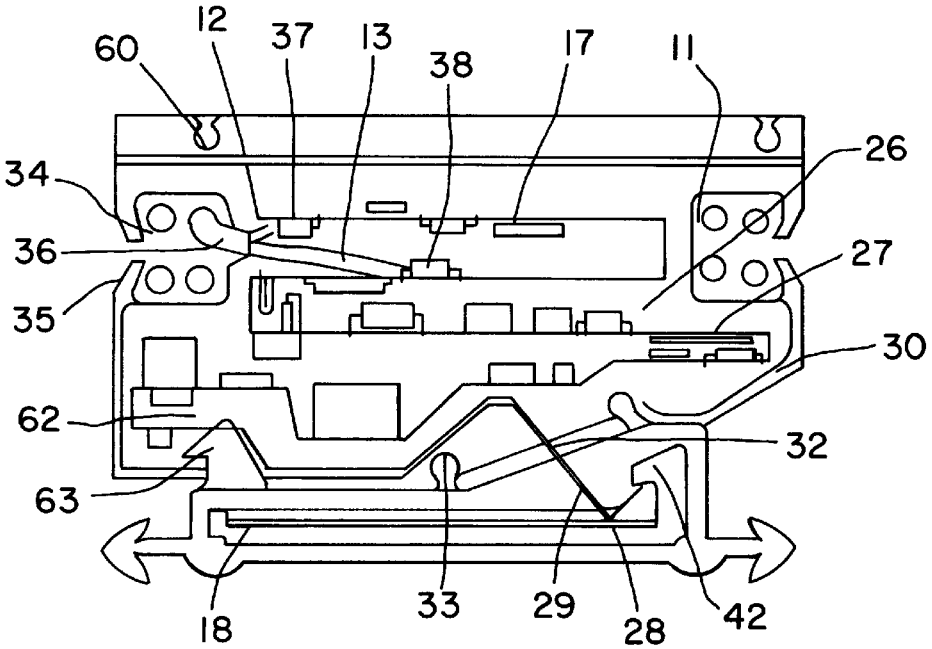
FIG. 8 shows the bus coupler of FIG. 7 in a vertical section on a larger scale.

The solution to the task of designing the entire system water-tight enough that spray water cannot penetrate into the electrical circuitry during cleaning of the engines is seen in the fact that the electronic converter circuit (17), which is embedded in a synthetic resin block (26), is designed in flexible conductor film technology and one part of the flexible conductor film (27) is provided with contact terminals (28) on the flexible films, in which the flexible conductor film (27), with the contact terminals (28) on the flexible film, is glued onto a contact spring assembly (29), which is fixed in a synthetic resin block (26) and protrudes from this with the contact terminals (28), which match the countercontacts (39) of the bus line (40), as follows in particular from FIG. 8.

By enclosing the electronic converter system (17) embedded in synthetic resin block (26), including the corresponding flexible conductor film (27), with a rubber skin (30) that clamps the synthetic resin block (26), a bus coupler (31) is formed, from which the contact terminals (28) on the flexible film protrude with the contact spring assembly (29). For this purpose, the rubber skin (30) of the bus coupler has a slit-like opening (32) that is enclosed over its extent with a hollow snap-in groove (33) formed in the rubber skin (30), as can be gathered in particular from FIGS. 8 and 11.

Figure 9:
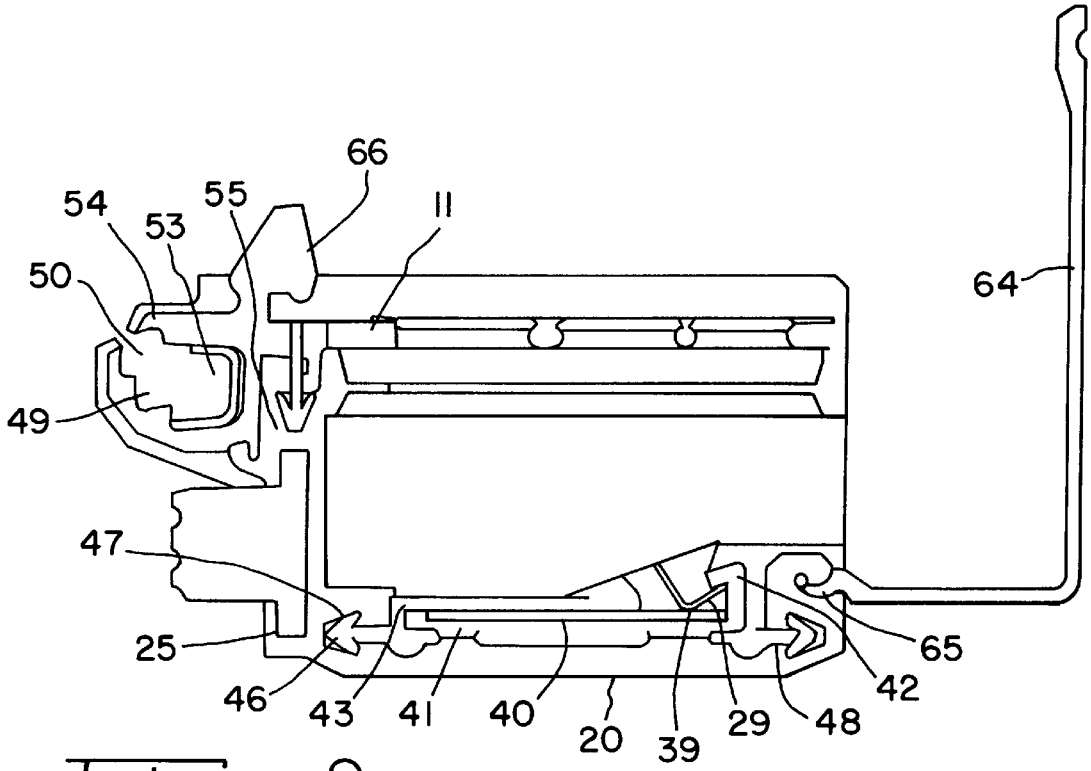
FIG. 9 shows the bus coupler of FIG. 7 with details of the connection area on a larger scale.
Figure 10:
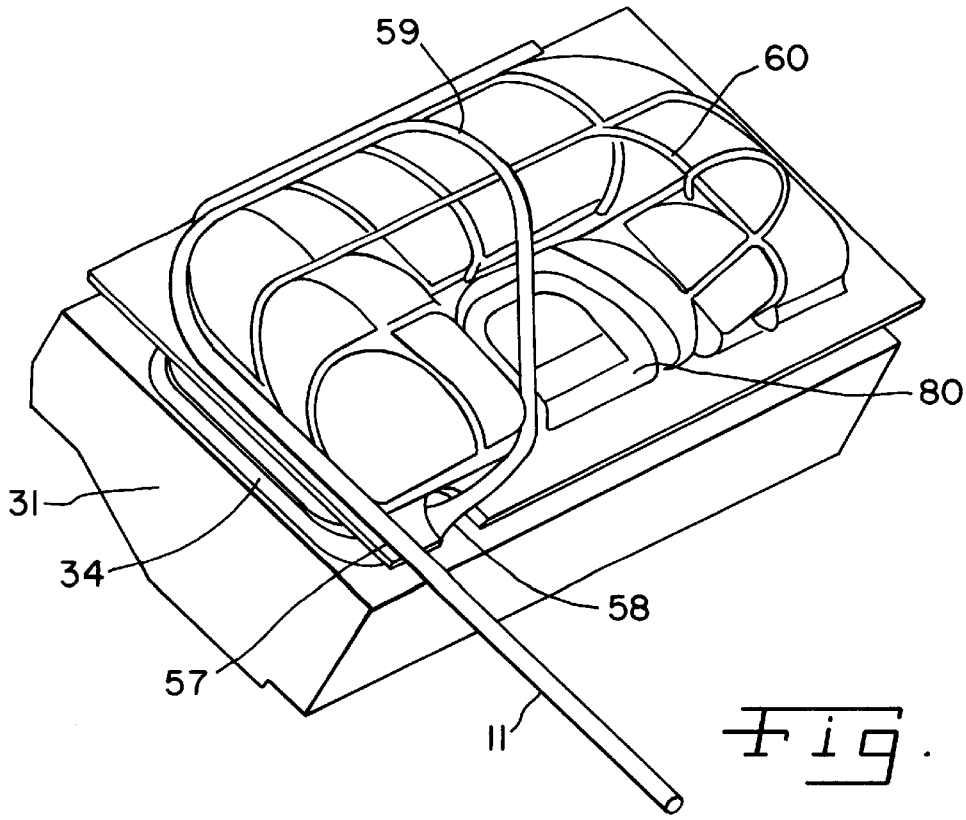
FIG. 10 shows a line guide region in the bus coupler of FIG. 9 with the assumed sheathing in a view from the top in a diagrammatic view.

FIGS. 8, 9 and 10 show that a winding channel (34) with holding lips (35) is formed in rubber skin (30), to accommodate, depending on the engine type, the unrequired standard length of the glass fiber cable (11), which is introduced to the electronic converter system (17) with its end via a tubular opening (36), enclosing the fiber optic cable (11) water-tight in the rubber skin (30) in the interior of the winding channel (34), in which the glass fibers for light feed line (12) are introduced to a light-emitting diode (37) and the glass fibers for light return line (13) are introduced to a light-sensor converter diode (38).

Figure 6:
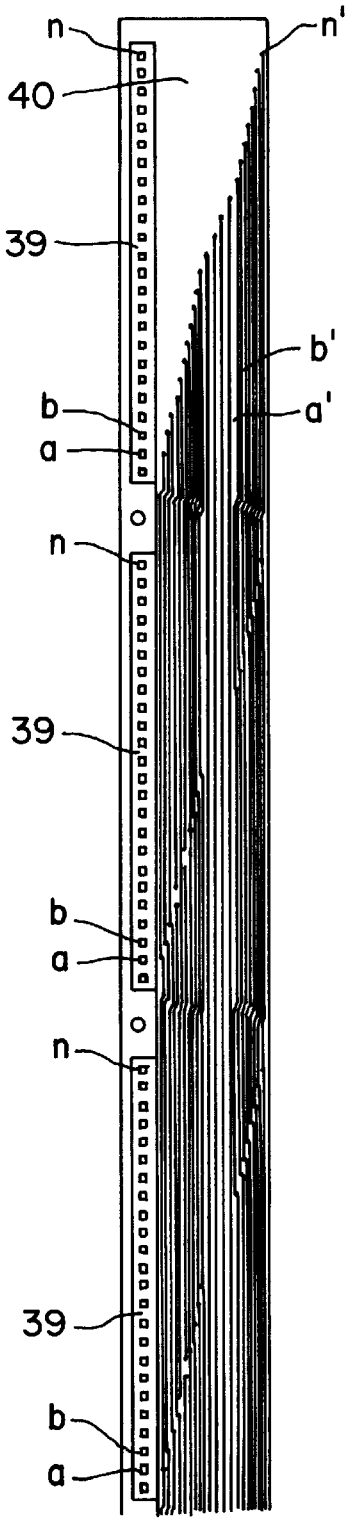
FIG. 6 shows a bus line rail of the support rail in a top view.
Figure 7:
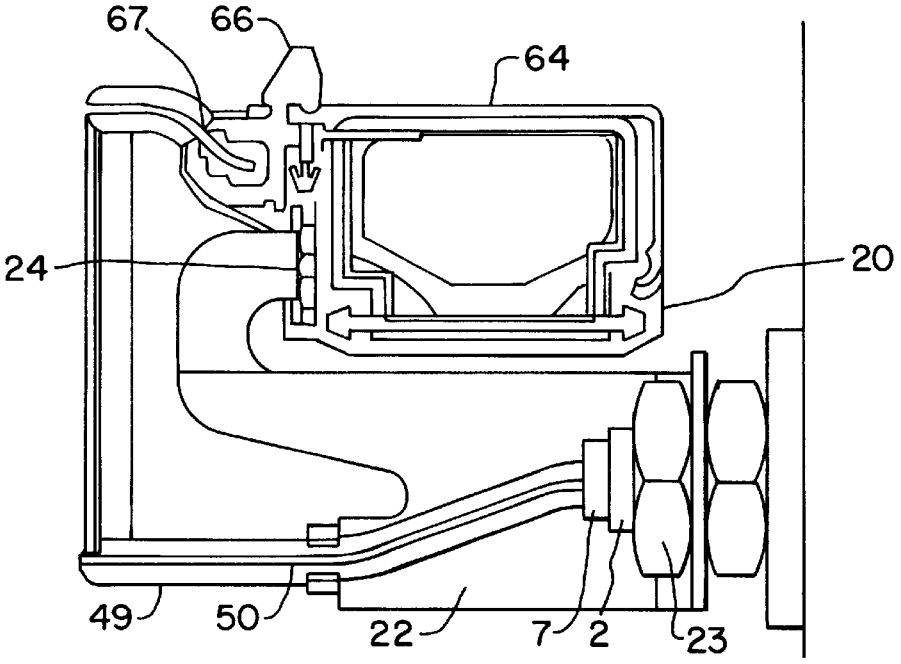
FIG. 7 shows the connection between measurement probe, bus coupler and bus rail in a view transverse to the bus rail.

The bus line rail (18) contains the bus line (40), designed as an electronic circuit board in the standard length of the bus support rail (20), and possesses the bus countercontacts (39), as shown in FIG. 6 in a section of the bus line on the bus board (40). The etched bus lines a', b' to n' are connected via an etched circuit board system to the corresponding bus countercontacts a, b to n, which the contact terminals on the flexible film (28) precisely match. In this manner, all corresponding bus countercontacts (39) a, b to n are connected to each other.

Figure 11:
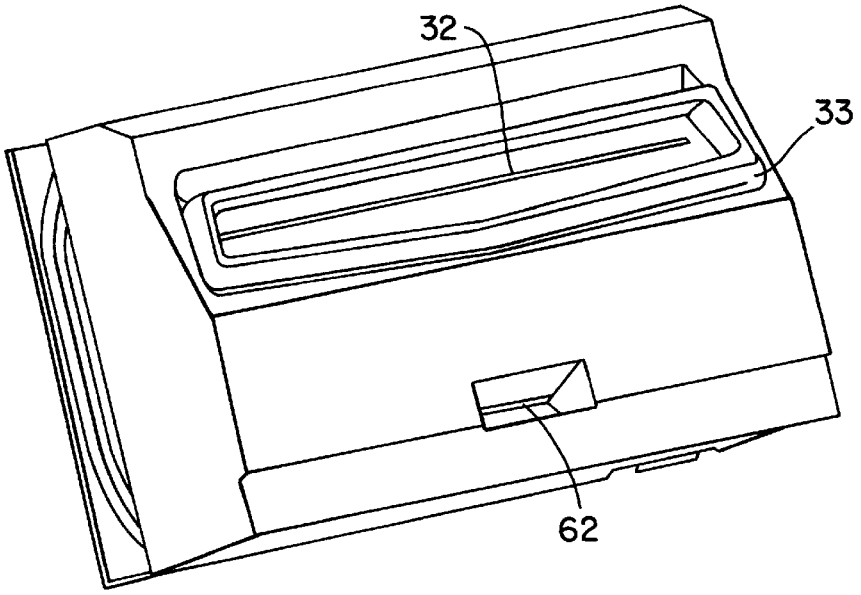
FIG. 11 shows the bus coupler of FIG. 8, viewed on the terminal contact region in a diagrammatic view.
Figure 12A:
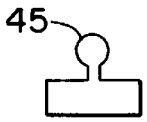
FIG. 12 shows the bus rail viewed on the terminal contact region for the bus coupler in a diagrammatic view.
Figure 11A:
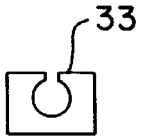
Figure 12:
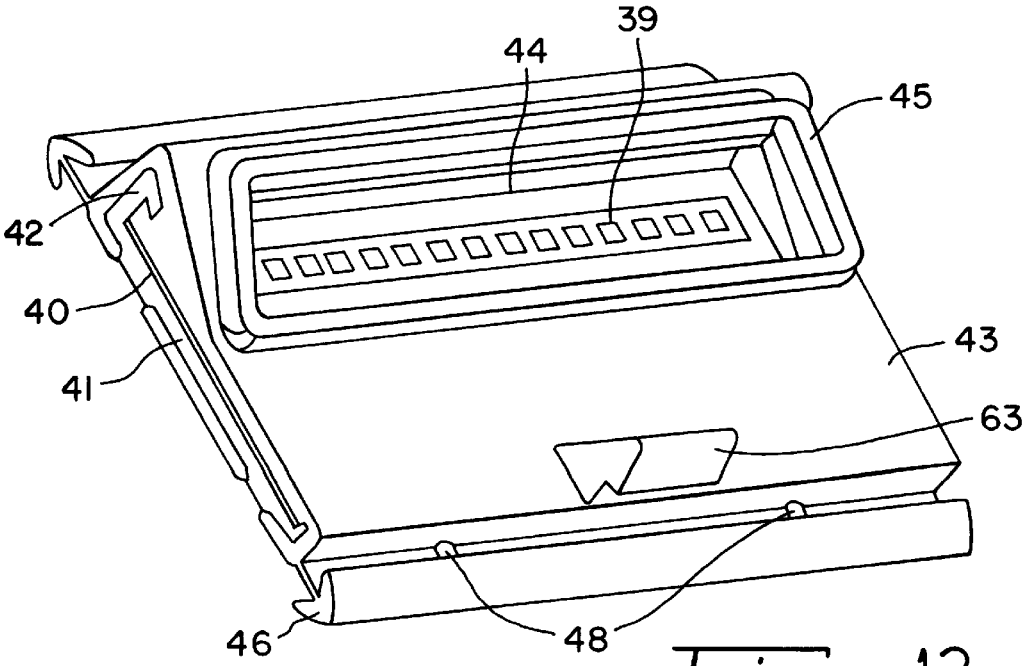
Figure 13:
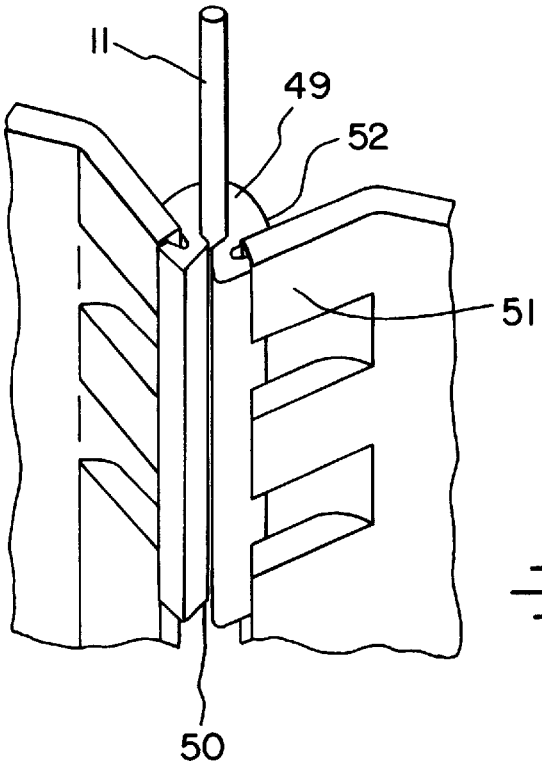
FIG. 13 shows a support rail mount with guides for the conductors in section and in a diagrammatic view.
Figure 14:
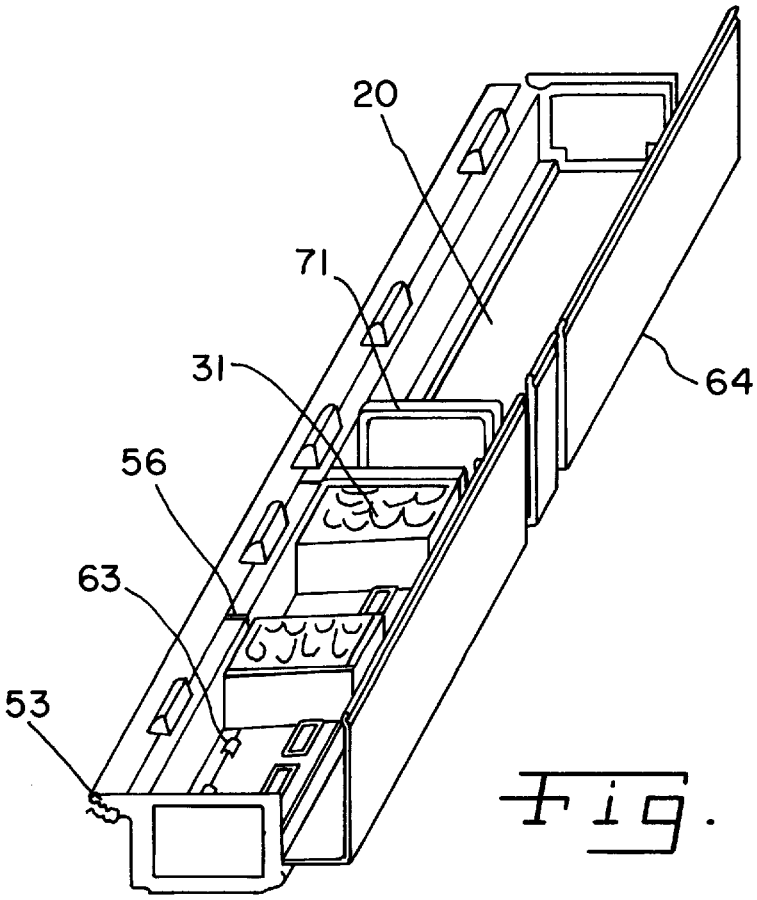
FIG. 14 shows the bus rail in the opened state and in a diagrammatic view.

The bus board (40), as follows in particular from FIGS. 9 and 12, is glued onto a bus metal rail (41) with spring support hook profile (42). The bus couplers (31) engage during insertion into the bus support rails (20) with the free end of the contact spring assembly (29) beneath the spring support hook profile (42), so that during shape-mated forcing down of the bus coupler (31) onto the bus line rail (18), the contact terminals (28) of the flexible film are connected to the bus countercontacts (39) and the required contact pressure is obtained. FIGS. 9 and 12 show how the bus board with the etched bus lines (40) are vulcanized, together with the bus metal rail (41), into a rubber skin (43) for water protection. The bus countercontacts (39) are left open by a slit-like bus countercontact opening (44) in the bus rubber skin (43). The slit-like bus countercontact opening in the bus rubber skin (43) is enclosed by a sealing rim (45) and fits with its sealing rim (45), shown in section, into the receiving profile of the hollow snap-in groove (33) shown in section (FIGS. 8, 11 and 12) and snaps into the bus support rail (20) water-tight during insertion of the bus coupler (31). By enclosing the bus line rail (18) in the bus rubber skin (43) and enclosing the electronic converter system (17), including the corresponding flexible conductor film (27) in rubber skin (30) so that the bus coupler (31) is formed in the hollow snap-in groove (33) formed from the rubber skin (30), the entire electronic system is closed water-tight.

The solution to the task of protecting the electronic converter system (17) with bus coupler (31) and the contact terminals (28) on the flexible film and the bus countercontacts (39) from damage from vibrations that are produced by the running engine, as shown in FIGS. 9 and 12, is seen in the fact that the rubber skin (43) of the bus line rail (18) is provided over its entire length, which corresponds to the length of the bus support rail (20), with a rubber support profile (46) on both sides over the entire length, which is threaded into the support grooves (47) of the bus support rail, so that the entire bus line rail (18) is clamped between the two support grooves (47) of the bus support rail (20). For this purpose, an elastic rubber joint (48) is produced during the vulcanization process of the bus line rail (18) between the rubber skin (43) of the bus line rail (18) and the two rubber support profiles (46). The elastic rubber joint (48) is designed so that the entire mass suspended on it, consisting of the bus line rail (18) and the electronic converter system (17) accommodated on it, forms a mechanical oscillation system with a resonance frequency tuned to low frequency. Because of this, the harmful higher frequency mechanical vibrations cannot influence the electronic converter system (17) and the contact connections between the contact terminals (28) on the flexible film and the bus countercontacts (39).

It follows in particular from FIGS. 7 to 10 and 13 that the glass fiber cable (11), emerging from measurement chamber (7), is accommodated in a slotted tube (49), into which it is introduced through slit (50). The slotted tube (49) itself is guided and fastened on the bus support rail mount (22) by means of support tongues (51), which, in turn, engage in a groove profile (52) on both sides of the slit (50) of the slotted tube (49). The slotted tube again ends in a collecting channel (53), which is also provided with a slit (54), so that the glass fiber cable (11) can also be introduced to the slotted tube (49) when this is introduced to the collecting channel (53). The collecting channel (53), made of rubber, passes over the entire standard length of the bus support rail (20), in which it is attached by means of a support profile in a corresponding support groove (55) in the bus support rail (20) over the entire standard length of the bus support rail (20).

According to FIGS. 7 to 10, the glass fiber cable leaves collecting channel (53) via a slotted passage (56) in collecting channel (53) and reaches the bus coupler on the input site (57) and then enters the winding channel of the bus coupler at the input site (58). The remaining length of the standard glass fiber cable not definable by whole-number coil lengths forms a loop (59), which is forced into the matching support groove (60) on the top of bus coupler (31) (FIG. 10). In this manner, the sensor unit (61), consisting of the measurement chamber with the sensor parts (14, 15, 16) accommodated in it, the glass fiber cable (11) and the bus coupler (31), is easily replaceable, in which the sensor can be removed from the bus support rail (20) and the glass fiber cable can be withdrawn through the slotted passage in collecting channel (56) from the collecting channel (53) and can also be pulled out from the slotted tube (49) through the slit (50) in the slotted tube, even if the latter is introduced with its end slightly in collecting channel (53), whereupon the measurement chamber (7) can be removed from the support tube (2). A replacement sensor unit (61) can be reinserted into the system in the opposite sequence. The slotted tube (49) is attached with its groove profiles (52) in collecting channel (53), so that the slit (50) in slotted tube (49) and the slotted passage (56) in collecting channel (53) lie precisely above each other.

To secure the bus coupler (31) pressed down in shape-mated fashion onto the bus line rail (18) on the opposite side of the spring assembly (29) locked into the spring support hook profile (42), according to FIGS. 11 and 12, a locking groove (62) is formed in the rubber skin (30) of the bus coupler, into which a locking hook (63) made in the rubber skin of bus line rail (18) snaps.

To release the converter serving as bus coupler from this anchoring, a loop (80) is formed on its top (FIG. 10) in the rubber skin (30), so that during pulling on this loop (80), the rubber skin (30), spanning the synthetic resin block (26) at the site of the locking groove (62), is stretched or pulled back so far that the locking hook (63) is released.

Solution of the task of protecting the electronic converter system from electromagnetic influences from the outside and, on the other hand, preventing electromagnetic radiation outward from the electronic circuits, is seen in the fact that, especially according to FIGS. 7 to 15, no additional shielding measures are required by the use of glass fiber cable (11) to transmit the sensor signals outside of the bus support rail (20). By embedding the bus line rail (18) and the bus coupler (31) in the metallic bus support rail (20) and by using a metallic support rail closure cover (64), which engages electrically conducting into the bus support rail (20) with its cover hinge (65) and is held down on the other side by a holding tab (66), which is formed in the rubber element of the collecting channel (53) (FIGS. 7 and 9), shielding of the electronic system in the interior of the cavity formed from the bus support rail (20) and the support rail closure cover (64) is almost guaranteed with maintenance of corresponding, generally known grounding measures.

To restrain electromagnetic waves from penetrating at the introduction slit (67) for the glass fiber cable between bus support rail (20) and support rail closure cover (64), the rubber element forming the collecting channel (53) is produced from a conducting rubber material.

As follows in particular from FIGS. 3 to 6, electrical connection between the individual bus line rails (18), which are inserted in the bus support rails (20) multiply mounted on the engine, occurs via bus connection lines (68) designed in cable form, which electrically connect the etched bus lines on the bus boards (40) of the bus line rails (18). For this purpose, the numerous flexible bus connection lines (68) present in a system end on each side in a bus line rail coupler (69). These bus line rail couplers (69) are designed similarly to the bus couplers (31), but contain no electronic converter system (17), no winding channel (34) and no support grooves (60). Because of this, they can be designed smaller in dimensions than the bus couplers (31) and can therefore be pushed through the connection element made of conducting rubber (71). The support rail intermediate pieces (2) are produced from the same metallic parts as the bus support rails (20) and are also provided with a metallic cover (64) (FIG. 15), which is kept closed in the closed state by the holding tab (66) of a collecting channel (53). The bus support rails in these intermediate pieces are installed with bus connection lines (68). Mechanical connection of the bus support rails to the support rail intermediate pieces (21) occurs via a metallic connection tongue (70), which is pushed on both sides into the T-shaped mounts (25) of the bus support rail (20). Because of this, the bus support rails (20) and support rail intermediate pieces (21) are stabilized in their longitudinal alignment direction.

As follows from FIGS. 3 to 4, as well as 14 and 15, the bus support rails (20) and the support rail intermediate pieces (21) are connected by means of a component designed as a connection element (71) or intermediate piece made of conducting rubber, in order to prevent sliding out of the connection tongues (70) from the bus support rails (20) or the support rail intermediate pieces (21). The rubber not only prevents sliding out of the connection tongue (70) by elastic tightening, but the bus support rails (20) and the support rail intermediate pieces (21) are also clamped together in the longitudinal direction. For this purpose, the connection elements (71) are provided with metal clamping tongues (72) that are introduced flat in the longitudinal direction of the support grooves into the bus support rails and, during assembly of the frame (71) in the profile cutting plane, are clamped in the support grooves (47) of the bus support rails (20) because they are kept somewhat larger in dimensions than the support grooves (47) of the bus support rails (20). The connection element (71) is thus firmly connected to the bus support rail (20).

The connection element (71) is prevented from tilting back in the flat introduction direction by a special holding device between the connection element (71) and the collecting channel (53).

The support rail intermediate pieces (21) are connected to the connection element (71) in that a metal frame (73) with metal frame clamping tongues (74) in the support rail intermediate piece with the cover (64) swiveled back is flatly introduced into the support grooves (47), which are also provided on the support rail intermediate pieces (21), as described above for the connection element (71) made of conducting rubber, then raised and locked into a frame groove (75) of connection element (71).

The bus connection lines (68), to simplify assembly of the system and to simplify spare parts supply, are also designed with the maximum required standard length to cover the greatest possible length of the support rail intermediate piece (21). Since the spacings between the bus support rails (20) and thus the support rail intermediate pieces (21) are of different length, depending on engine size, to fill the gaps between the bus support rails (20), the excess length of the bus connection line (68) is inserted wave-like into the support rail intermediate piece (21). Several bus coupling sites (44) are uniformly distributed on the bus line rail (18) over the entire standard length of the bus support rails (20). On the coupling site (44) present on the end of the last bus support rail (20), a signal evaluation unit (76), like a bus coupler (31), can be mounted. This signal evaluation unit (76) contains an electronic evaluation circuit similar to the electronic converter system (17) of bus coupler (31). A connection line (77) is withdrawn from this signal evaluation unit (76), which ends in a plug-in connection (78) that permits transmission of the signals to other electrical devices (not shown), as well as power supply for the electronic circuits accommodated in the bus support rails (20) for the bus coupler (31) and the signal evaluation unit (76).

Figure 3:
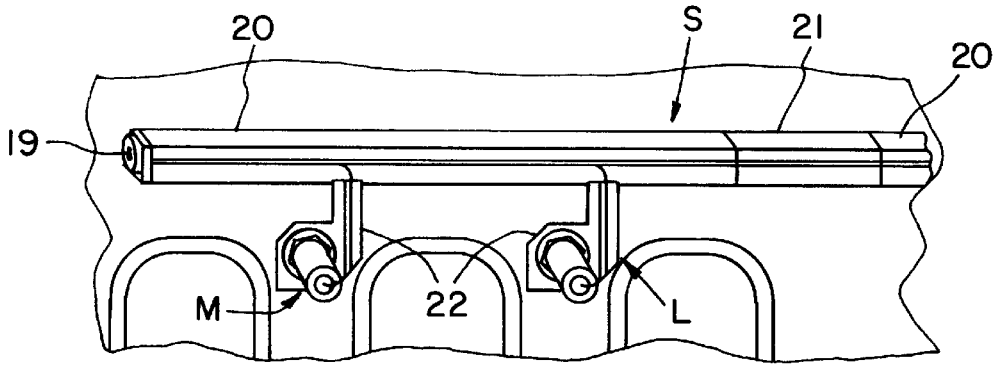
FIG. 3 shows the arrangement of the measurement probe and a bus rail on a machine in a diagrammatic view.
Figure 4:
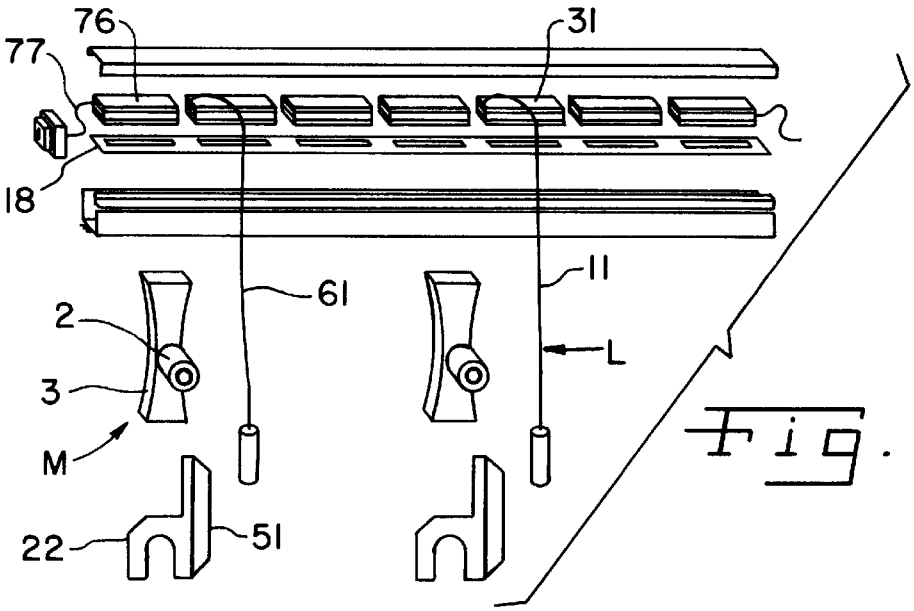
FIG. 4 shows the arrangement according to FIG. 3 in an exploded view.
Figure 5:
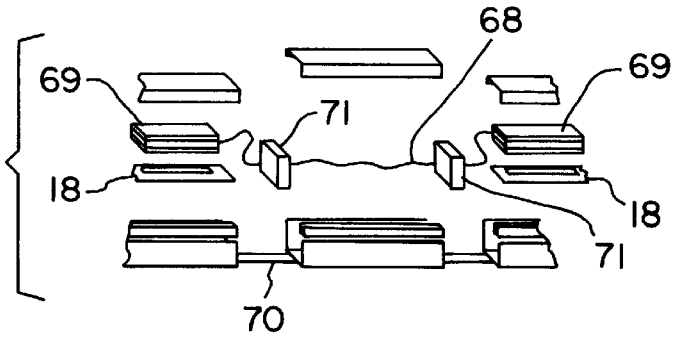
FIG. 5 shows a section from the bus rail in FIG. 3 in an exploded view.
Figure 15:
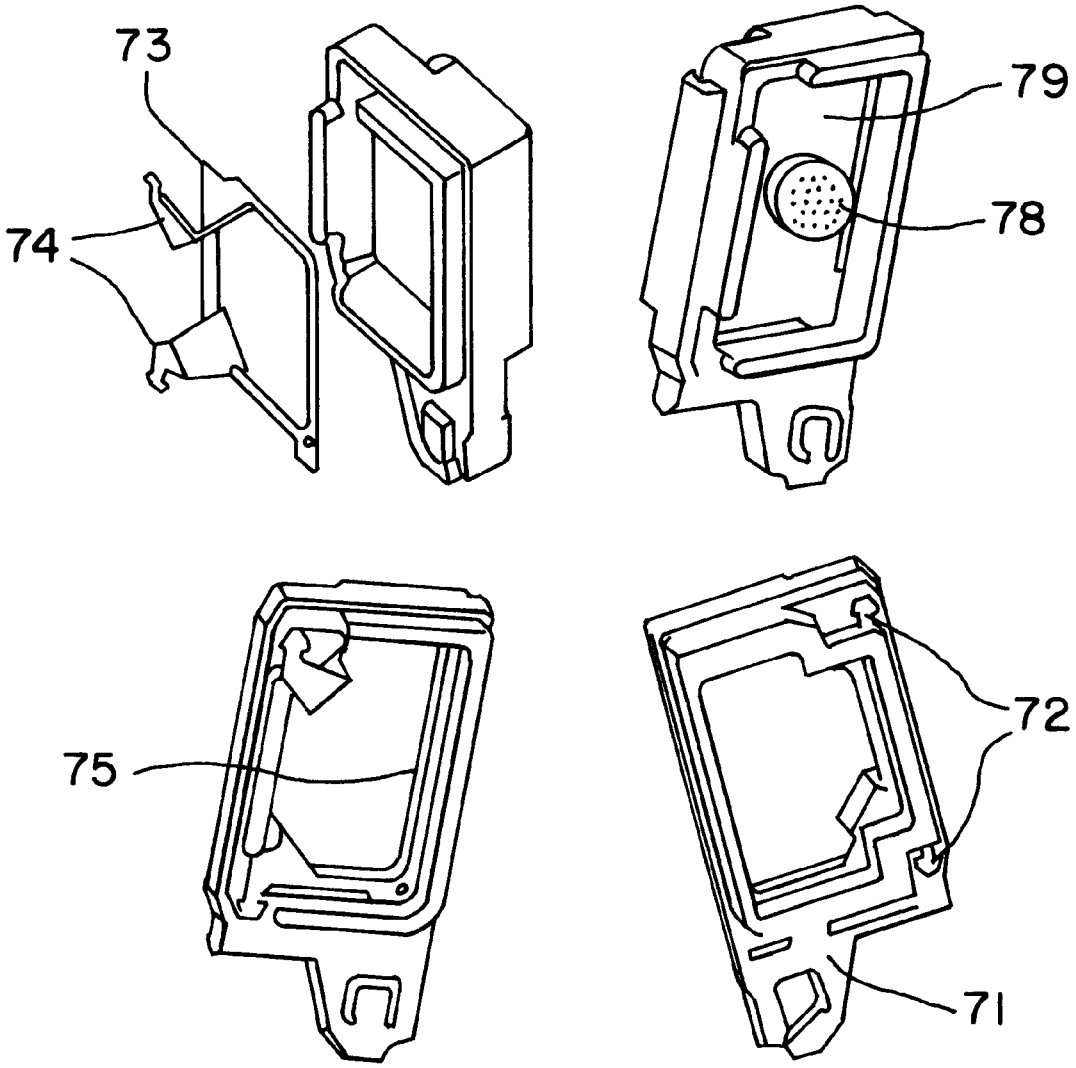
FIG. 15 shows a component that is designed as an intermediate piece for connection of the bus rail sections or as an end piece for termination of the bus rail in different views and in a diagrammatic view.

An end piece (19) forms the termination of the bus rail, which is shown in FIGS. 3 and 15. This plug-in connection (78) is again inserted into a metal terminal plate (79), which is inserted into the frame groove (75) of a connection element (71) on the outer end of a bus support rail (20) instead of the metal frame (73). In the same manner, the other end of the combination of bus support rails (20) with an end piece is terminated with a metal terminal plate (79), but without plug-in connection (78).

The penetration of electromagnetic waves at the end site of a support rail (20) is prevented by the metal terminal plate (79) and the connection element made of conducting rubber (71) as support rail end termination.

In another embodiment of the system, the bus line signals are not evaluated within the support rail (20), but fed to an external evaluation unit. This is also connected via a plug-in connection (78) in the manner just described, but in which the plug-in connection (78) is connected by means of a bus line rail coupler, similar to (69), to the bus line system (40) of the bus line rail (18).

Another embodiment of the invention consists of using other sensors that do not measure oil mist density via the bus system, consisting of the bus support rails (20), the bus line rails (18), the support rail closure cover (64), the connection element (71) and the connection element (71) with metal terminal plate (79), as well as the bus support rail mounts (22), the slotted tube lines (49), as well as the connecting channel (53), for other sensors with a glass fiber signal line or also with a copper line. In this case, the bus support rail mounts (22), as already described in the oil mist monitoring system, can be attached to the sensor mounts themselves. In another embodiment of the invention, however, slotted tube lines (49) in specially configured guide channels with mounting tongues (51) for the slotted tubes (49) can be used to accept the signal lines of the different sensors, which are then, in turn, mounted on the corresponding engine.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A device for determining measured values in a chamber of a machine, the device comprising;

a housing of the machine;

an evaluation device arranged outside of said housing;

a measurement probe attached to said housing and extending into the chamber;

an oscillating system having a line connected between said measurement probe and said evaluation device; and a support rail containing a bus rail with a bus line rail, said line connected to a bus coupler containing an electrical converter arranged in said bus rail, said bus line rail arranged elastically within said support rail so that said system is tuned to a low frequency.

2. A device according to claim 1 in which a guide tube is arranged on the housing for replaceable insertion of a measurement probe.

3. A device according to claim 1 in which said measurement probe is designed as an optical probe, which is connected to said bus coupler via a light guide, said electronic converter to convert optical signals to electrical signals.

4. A device according to claim 3 in which said bus coupler has a light emitter and a light receiver that are connected via a light feedline and a light return line to said probe.

5. A device according to one of the claim 1 in which said bus coupler has a synthetic resin block, in which the components and the connection of line are cast, and which is enclosed with a rubber sheath, from which contact terminals protrude for connection to countercontacts of said bus line rail of said bus rail.

6. A device according to claim 5 in which said fact that the bus coupler has a laterally-running winding channel, and a support groove on the top to accommodate excess lengths of a conductor.

7. A device according to claim 5 in which said bus coupler has a toothed profile surrounding contact connections for connection to said bus line rail, and a locking device for locking with the bus line rail.

8. A device according to claim 1 in which said line rail including a circuit board with terminal contacts for said bus coupler, and which is attached to a metal rail having a spring-loaded hook profile facing said bus coupler for shape-mated locking with said bus coupler.

9. A device according to claim 8 in which said circuit board and said metal rail are enclosed by a rubber sheath which has an opening that exposes terminal contacts.

10. A device according to claim 9 in which said rubber sheath has rubber support profiles on both long sides of said bus line rail connected via elastic rubber connections, which are inserted into corresponding support profiles in said support rails.

11. A device according to claim 1 in which said bus line rail is arranged elastically in said support rail so that it is prestressed against the bus coupler and forms an oscillating system with it.

12. A device according to claim 1 in which said support rail is connected to a pivotable cover that covers bus coupler.

13. A device according to claim 1 in which said support rail has, on the outlet side of line, a collection channel made of rubber into which said line (L) is introduced via a slit and further conveyed to said bus coupler.

14. A device according to claim 1 in which said support rail has a T-shaped mounting groove, into which a support tongue of a support rail mount is inserted, which said support rail is connected to a guide tube to be connected to said housing.

15. A device according to claim 1 in which said line is guided from said bus rail to said measurement probe in a tube provided with a longitudinal slit.

16. A device according to claim 1 in which said bus rail is connected by means of an intermediate piece to an additional bus rail, in which a metallic connection tongue, insertable into both said support rails is arranged for mechanical connection, and a rubber-elastic connection element, corresponding to the internal profile of said support rail and said intermediate piece;

said intermediate piece containing on both sides a metal frame with clamping tongues, which engage in the support grooves in said support rails.

17. A device according to claim 1 in which said bus rail is terminated on its ends by an end piece inserted into the support rail, said end piece containing a rubber element, and a metal plate, said metal plate containing clamping tongues which engage into support grooves in said support rail, said end piece optionally containing a plug-in connection, which is connected via a line to a bus terminal coupler, which is inserted similarly into said bus coupler into said bus rail and connected to said bus line rail.

18. A device according to claim 1 in which said bus rail has a bus terminal coupler for connection to other members, said bus rail inserted into said support rail and is connected to the bus line rail and has a connection line.

* * * * *